US011441524B2

(12) United States Patent
Lee

(10) Patent No.: US 11,441,524 B2
(45) Date of Patent: Sep. 13, 2022

(54) PIEZOELECTRIC INJECTOR AND METHOD FOR CONTROLLING THE SAME

(71) Applicants: HYUNDAI MOTOR COMPANY, Seoul (KR); KIA MOTORS CORPORATION, Seoul (KR)

(72) Inventor: Hyeon Jin Lee, Yongin-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 140 days.

(21) Appl. No.: 17/084,252

(22) Filed: Oct. 29, 2020

(65) Prior Publication Data

US 2021/0381477 A1 Dec. 9, 2021

(30) Foreign Application Priority Data

Jun. 9, 2020 (KR) ..... 10-2020-0069629

(51) Int. Cl.

| | |
|---|---|
| ***F02M 51/06*** | (2006.01) |
| ***F02M 61/10*** | (2006.01) |
| ***F02M 61/18*** | (2006.01) |
| ***F02M 55/00*** | (2006.01) |

(52) U.S. Cl.

CPC ..... *F02M 51/0603* (2013.01); *F02M 55/002* (2013.01); *F02M 61/10* (2013.01); *F02M 61/1853* (2013.01)

(58) Field of Classification Search

CPC ..... F02M 51/0603; F02M 55/002; F02M 61/10; F02M 61/1853; F02M 61/167; F02M 61/18; F02M 47/027; F02M 59/466; F02M 63/0026; F02M 2200/21; F02D 41/2096

USPC ..... 123/472, 490; 251/129.15

See application file for complete search history.

(56) References Cited

U.S. PATENT DOCUMENTS

2005/0145221 A1* 7/2005 Niethammer ..... F02M 59/34 239/584

FOREIGN PATENT DOCUMENTS

WO WO 03004857 A1 * 1/2003 ..... F02M 45/12

* cited by examiner

*Primary Examiner* — Hai H Huynh

(74) *Attorney, Agent, or Firm* — Lempia Summerfield Katz LLC

(57) ABSTRACT

A piezoelectric injector includes: a first piezo actuator and a second piezo actuator; a control valve connected to the first piezo actuator and the second piezo actuator through a control piston; at least one drain chamber in which the control valve and the control piston are movably received; a control chamber connected to the drain chamber through a first drain throttle and a second drain throttle having different diameters; and a needle movable by a change in fuel pressure of the control chamber to open and close at least one nozzle orifice. As at least one of the first piezo actuator and the second piezo actuator expands, a fuel is drained from the control chamber to the drain chamber through at least one of the first drain throttle and the second drain throttle.

17 Claims, 12 Drawing Sheets

PIEZOELECTRIC INJECTOR AND METHOD FOR CONTROLLING THE SAME

CROSS-REFERENCE TO RELATED APPLICATION

This application is based on and claims the benefit of priority to Korean Patent Application No. 10-2020-0069629, filed on Jun. 9, 2020, in the Korean Intellectual Property Office, the disclosure of which is incorporated herein in its entirety by reference.

TECHNICAL FIELD

The present disclosure relates to a piezoelectric injector and a method for controlling the same, and more particularly, to a piezoelectric injector and a method for controlling the same capable of efficiently providing variable control of a fuel injection rate by varying a fuel injection rate pattern depending on a rail pressure for a given engine operating condition.

BACKGROUND

A common rail fuel injection system is designed to directly inject a fuel into a combustion chamber of an engine. The common rail fuel injection system may compress the fuel in a fuel tank at high pressure, supply it to a common rail to accumulate it under high pressure, and inject the fuel accumulated in the common rail into the combustion chamber through a fuel injector.

Such a common rail fuel injection system includes a plurality of fuel injectors corresponding to respective cylinders of the engine, a common rail acting as an accumulator in which the fuel is held to maintain a relatively high target rail pressure, a high pressure pump pressurizing the fuel sucked from the fuel tank through a feed pump (a low pressure pump) at high pressure and supplying it into the common rail, and a controller controlling the fuel injectors, the high pressure pump, etc.

The fuel injector is mounted on an engine cylinder head of a vehicle and injects the fuel into the combustion chamber. The fuel injector may be a solenoid injector, a piezoelectric injector, or the like.

The piezoelectric injector includes an injector body, a piezo actuator mounted in the injector body, a control valve moved by the piezo actuator, and a needle moving up and down in accordance with the movement of the control valve to open and close nozzle orifices. A control chamber or control volume is disposed above the needle, and a nozzle chamber is disposed under the needle. A low pressure chamber is disposed above the control chamber. The low pressure chamber and the control chamber are connected through an outlet throttle. A high pressure fuel passage receiving the high pressure fuel from the common rail is connected to the nozzle chamber through a nozzle throttle. The high pressure fuel passage and the control chamber are connected through an inlet throttle. Thus, the piezoelectric injector is able to supply a required fuel injection amount into the combustion chamber through control of fuel injection duration.

A piezoelectric injector according to the related art controls the fuel injection duration depending on a rail pressure for a given engine operating condition but cannot vary, i.e., change a fuel injection rate pattern depending on a rail pressure for a given engine operating condition. In other words, the related art piezoelectric injector fails to actively change the fuel injection rate in response to the rail pressure for a given engine operating condition.

Since the related art piezoelectric injector cannot change the fuel injection rate, it has controlled injection timing in a manner that makes each injection timing as close as possible or extends it (e.g., adjusting an interval between a pilot injection and a main injection, and splitting the main injection into two smaller injections) through a study such as digital rate shaping (DRS). The controlled injection timing aims to achieve an optimal mapping of the injection timing. However, there are limitations in effectively achieving improvements in fuel efficiency, smoke emissions reduction, low combustion noise, etc. due to the dwell time of the injector itself.

The above information described in this background section is provided to assist in understanding the background of the inventive concept, and may include any technical concept which is not considered as the prior art that is already known to those having ordinary skill in the art.

SUMMARY

The present disclosure has been made to solve the above-mentioned problems occurring in the prior art while advantages achieved by the prior art are maintained intact.

An aspect of the present disclosure provides a piezoelectric injector and a method for controlling the same capable of efficiently providing variable control of a fuel injection rate by varying a fuel injection rate pattern depending on a rail pressure for a given engine operating condition.

According to an aspect of the present disclosure, a piezoelectric injector may include: an injector body having a high-pressure fuel passage; a nozzle provided in a lower end portion of the injector body, and having at least one nozzle orifice; a first piezo actuator and a second piezo actuator disposed inside the injector body; a control valve connected to the first piezo actuator and the second piezo actuator through a control piston; at least one drain chamber in which the control valve and the control piston are movably received; a control chamber connected to the drain chamber through a first drain throttle and a second drain throttle; and a needle movable by a change in fuel pressure of the control chamber to open and close the nozzle orifice, wherein a fuel may be drained from the control chamber to the drain chamber through at least one of the first drain throttle and the second drain throttle as at least one of the first piezo actuator and the second piezo actuator expands.

The first piezo actuator and the second piezo actuator may vary a displacement of the control valve.

The first drain throttle and the second drain throttle may have different diameters.

The first drain throttle may connect a bottom of the drain chamber and an upper end of the control chamber.

The second drain throttle may connect a lateral side of the drain chamber and the upper end of the control chamber.

A diameter of the second drain throttle may be larger than a diameter of the first drain throttle.

The first piezo actuator may be located outward from the second piezo actuator.

The first piezo actuator and the second piezo actuator may be connected to the control piston through a support bracket, the first piezo actuator may be disposed on an edge of the support bracket, and the second piezo actuator may be disposed on a center of the support bracket.

The support bracket may have a first support supporting the second piezo actuator, and a second support supporting the first piezo actuator.

A top surface of the second support may be located higher than a top surface of the first support.

The first piezo actuator and the second piezo actuator may be arranged in parallel to each other.

The first piezo actuator and the second piezo actuator may be vertically stacked.

According to another aspect of the present disclosure, a method for controlling the aforementioned piezoelectric injector may include: applying, by the controller, a current to at least one of the first piezo actuator and the second piezo actuator so that at least one of the first piezo actuator and the second piezo actuator expands.

The controller may apply the current to the first piezo actuator and the second piezo actuator at different timing so that the first piezo actuator and the second piezo actuator may expand at different timing.

The controller may only apply the current to the first piezo actuator so that only the first piezo actuator may expand.

The controller may only apply the current to the second piezo actuator so that only the second piezo actuator may expand.

The controller may apply the current to the first piezo actuator and the second piezo actuator sequentially so that the first piezo actuator may expand and the second piezo actuator may expand sequentially.

BRIEF DESCRIPTION OF THE DRAWINGS

The above and other objects, features and advantages of the present disclosure should be more apparent from the following detailed description taken in conjunction with the accompanying drawings.

DETAILED DESCRIPTION

Figure 1:
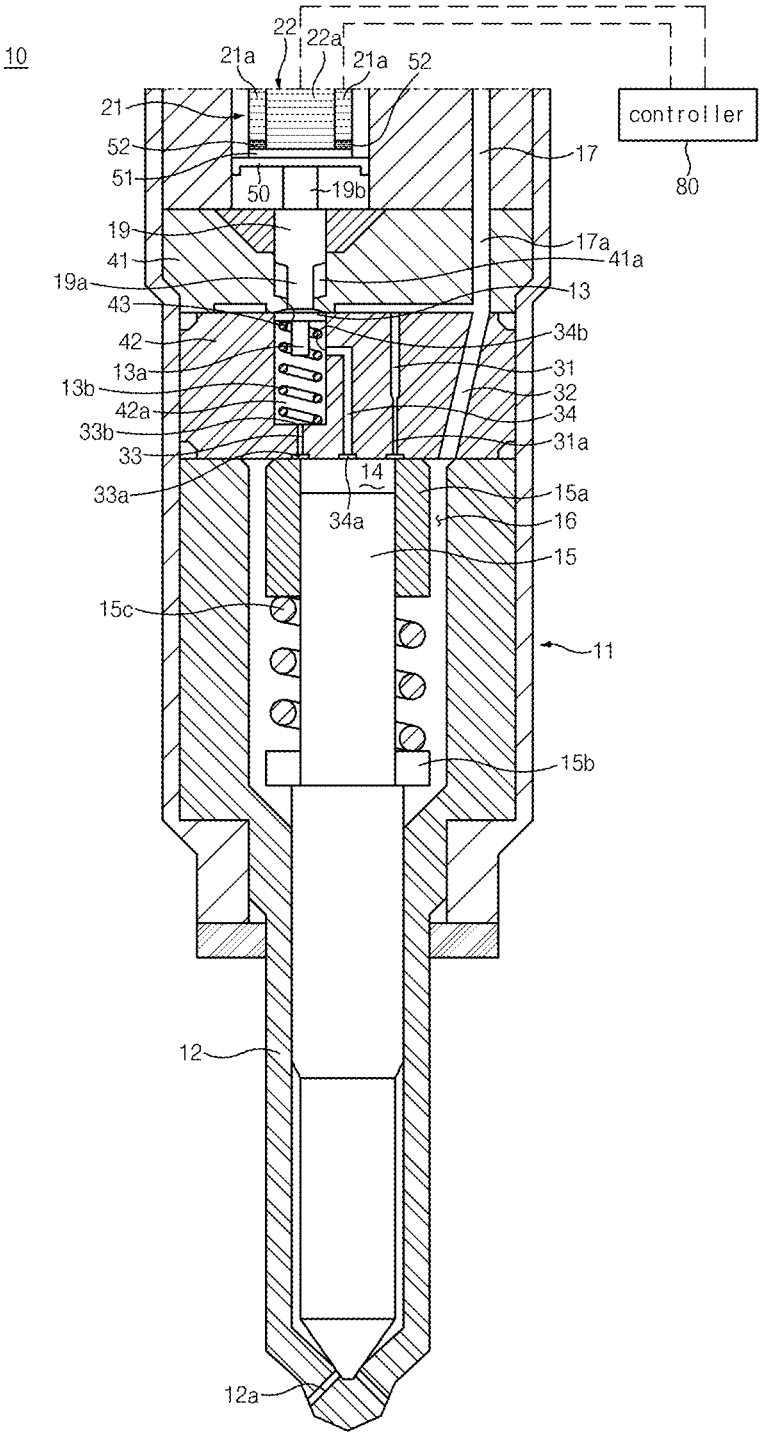
FIG. 1 illustrates a piezoelectric injector according to an embodiment of the present disclosure.

Hereinafter, embodiments of the present disclosure are described in detail with reference to the accompanying drawings. In the drawings, the same reference numerals are used throughout to designate the same or equivalent elements. In addition, a detailed description of well-known techniques associated with the present disclosure has been omitted in order not to unnecessarily obscure the gist of the present disclosure.

Terms such as first, second, A, B, (a), and (b) may be used to describe the elements in embodiments of the present disclosure. These terms are only used to distinguish one element from another element, and the intrinsic features, sequence or order, and the like of the corresponding elements are not limited by the terms. Unless otherwise defined, all terms used herein, including technical or scientific terms, have the same meanings as those generally understood by those having ordinary skill in the art to which the present disclosure belongs. Such terms as those defined in a generally used dictionary are to be interpreted as having meanings equal to the contextual meanings in the relevant field of art. Such terms are not to be interpreted as having ideal or excessively formal meanings unless clearly defined as having such in the present disclosure. When a component, device, element, or the like of the present disclosure is described as having a purpose or performing an operation, function, or the like, the component, device, or element should be considered herein as being "configured to" meet that purpose or to perform that operation or function. Further, the controller described herein may include a processor programmed to perform the noted operation, function, operation, or the like.

Figure 2:
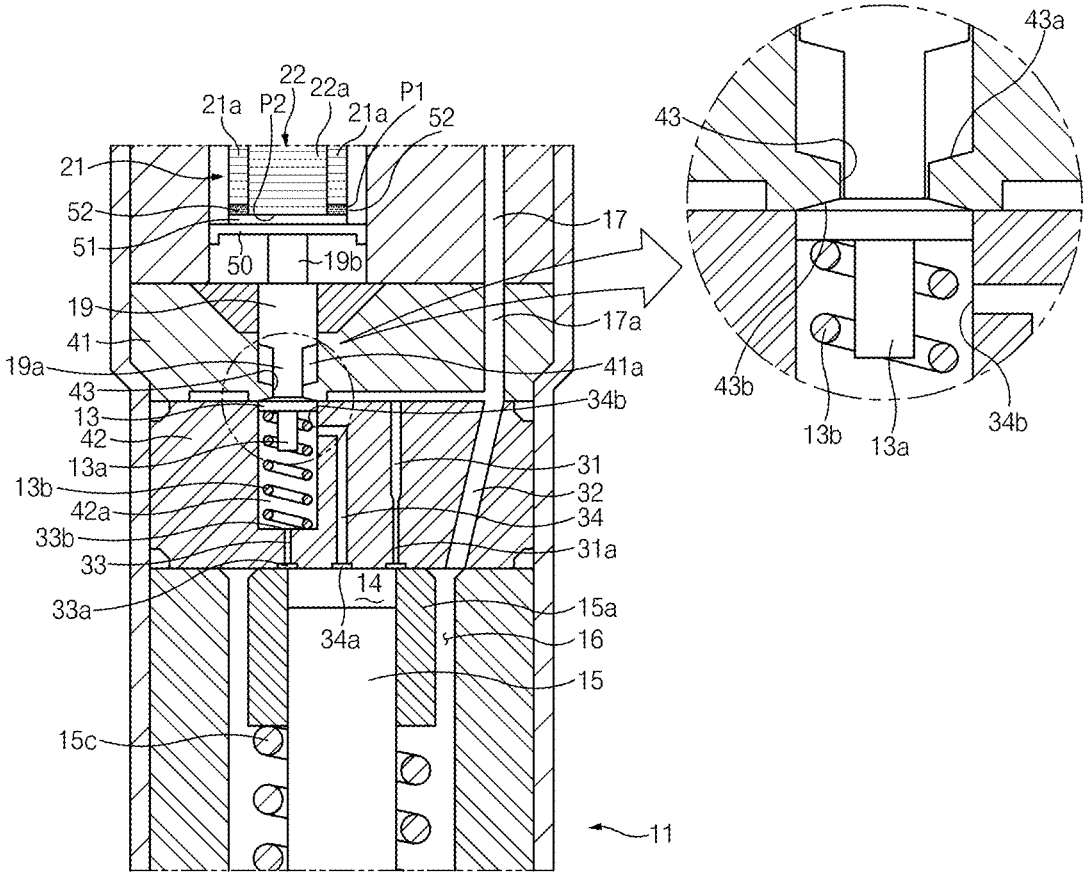
FIG. 2 illustrates an enlarged view of first and second piezo actuators, a control valve, a control chamber, and an upper end portion of a needle in a piezoelectric injector according to an embodiment of the present disclosure.

Referring to FIGS. 1 and 2, a piezoelectric injector 10 according to an embodiment of the present disclosure may include an injector body 11, two or more piezo actuators 21 and 22 disposed inside the injector body 11, a control valve 13 movable by the piezo actuators 21 and 22, a control chamber or control volume 14 located under the control valve 13, a needle 15 moving between an open position and a closed position by a change in fuel pressure of the control chamber 14, and a nozzle chamber 16 surrounding the control chamber 14.

The injector body 11 may include a nozzle 12 provided in a lower end portion thereof, and the nozzle 12 may have at least one nozzle orifice 12*a*. The nozzle orifice 12*a* may be formed in a bottom end of the nozzle 12, and the nozzle orifice 12*a* may be opened and closed by up-and-down movements of the needle 15.

A bushing 15*a* may be disposed around an upper end of the needle 15, and the control chamber 14 may be defined by an inner surface of the bushing 15*a* and the upper end of the needle 15. As the upper end of the needle 15 moves within the control chamber 14, a volume of the control chamber 14 may be varied, and thus a fuel pressure in the control chamber 14 may change. When the fuel pressure in the control chamber 14 is higher than a predetermined pressure, the needle 15 may move down toward the closed position in which the nozzle orifice 12*a* is closed. When the fuel pressure in the control chamber 14 is lower than a predetermined pressure, the needle 15 may move up toward the open position in which the nozzle orifice 12*a* is opened.

A washer 15*b* may be fixed to an outer surface of the needle 15, and the washer 15*b* may be spaced apart from the bushing 15*a* toward the bottom of the needle 15. A spring 15*c* may be disposed between the bushing 15*a* and the washer 15*b*. The needle 15 may return to its original position by the spring 15*c*.

The injector body 11 may have a high-pressure fuel passage 17 therein, and the high-pressure fuel passage 17 may be connected to a common rail through a supply port (not shown). The high-pressure fuel passage 17 may receive a high-pressure fuel from the common rail. The supply port (not shown) may be provided in an upper portion of the injector body 11.

The high-pressure fuel passage 17 may communicate with the control chamber 14 through an inlet throttle 31, and thus the high-pressure fuel may pass through the high-pressure fuel passage 17 and fill the control chamber 14. A small-diameter throttle 31*a* may be connected to a lower end of the inlet throttle 31, and a diameter of the small-diameter throttle 31*a* may be smaller than that of the inlet throttle 31. The high-pressure fuel passage 17 may communicate with the nozzle chamber 16 through a nozzle throttle 32, and thus the high-pressure fuel may pass through the high-pressure fuel passage 17 and fill the nozzle chamber 16.

The two or more piezo actuators 21 and 22 may be disposed in different positions inside the injector body 11. An upper end of each of the piezo actuators 21 and 22 may be fixed to the injector body 11, and a lower end of each of the piezo actuators 21 and 22 may move upward and downward within the injector body 11.

According to an embodiment, as electric energy is charged or discharged, each of the piezo actuators 21 and 22 may be expanded or contracted by being deformed. Specifically, the piezo actuators 21 and 22 may be piezo stack actuators in which a plurality of piezo elements 21*a* and 22*a* are stacked. For example, when the plurality of piezo elements 21*a* and 22*a* of 90 μm are stacked, and the electric energy is charged by applying a voltage of about 200V to the piezo elements 21*a* and 22*a*, the piezo elements 21*a* and 22*a* may be expanded by a length of about 1.5 to 2% due to an electric field. When the electric energy is discharged from the plurality of piezo elements 21*a* and 22*a* with no voltage applied, the piezo elements 21*a* and 22*a* may be contracted to their original state. As another example, when a forward current or a positive voltage is applied to each of the piezo actuators 21 and 22, each of the piezo actuators 21 and 22 may be expanded by a predetermined length. When a reverse current or a negative voltage is applied to each of the piezo actuators 21 and 22, each of the piezo actuators 21 and 22 may be contracted to its original state. A controller 80 may be electrically connected to the piezo actuators 21 and 22. The controller 80 may control the energizing or de-energizing of each of the piezo actuators 21 and 22, energizing time thereof, a voltage or current level applied to each of the piezo actuators 21 and 22, timing of application of the voltage or current, etc. depending on a rail pressure for a given engine operating condition. Thus, the controller 80 may receive information on the position of an accelerator pedal or a throttle pedal from an ECU (not shown) of the vehicle, allowing the optimal mapping of injection quantity, injection timing, and injection frequency for each operating point of the engine.

The two or more piezo actuators 21 and 22 may be operatively connected to a control piston 19 through a support bracket 50, and the support bracket 50 may connect the two or more piezo actuators 21 and 22 and the control piston 19.

The control valve 13 may move vertically by the piezo actuators 21 and 22. The control valve 13 may be connected to the plurality of piezo actuators 21 and 22 through the control piston 19 and the support bracket 50. As each of the piezo actuators 21 and 22 operates (contraction and expansion), the control valve 13 may move up and down with the control piston 19 and the support bracket 50. The control valve 13 may be referred to as a servo valve controlled by the controller 80 of a servo mechanism.

A lower end of the control piston 19 may be connected to the control valve 13 through a lower rod 19*a*, and an upper end of the control piston 19 may be connected to the support bracket 50 through an upper rod 19*b*.

The piezoelectric injector 10 according to an embodiment of the present disclosure may include a valve plate 41 and a throttle plate 42 disposed under the piezo actuators 21 and 22.

The valve plate 41 may be located under the piezo actuators 21 and 22, and the throttle plate 42 may be located under the valve plate 41.

The valve plate 41 may be located under the piezo actuators 21 and 22. The valve plate 41 may have a first drain chamber 41*a* in which the control piston 19 is movably received. For example, an outer surface of the control piston 19 may be spaced apart from an inner surface of the first drain chamber 41*a* by a fine gap, and thus the fuel may move through the gap between the outer surface of the control piston 19 and the inner surface of the first drain chamber 41*a*.

The throttle plate 42 may be located under the valve plate 41. The throttle plate 42 may have a second drain chamber 42*a* in which the control valve 13 is movably received. For example, an outer surface of the control valve 13 may be spaced apart from an inner surface of the second drain chamber 42*a* by a fine gap, and thus the fuel may move through the gap between the outer surface of the control valve 13 and the inner surface of the second drain chamber 42*a*.

The first drain chamber 41*a* may communicate with the second drain chamber 42*a* through an orifice 43, and the orifice 43 may be opened and closed by up-and-down movements of the control valve 13. An upper end of the orifice 43 may be provided with an upper tapered surface 43*a* corresponding to a lower inclined surface of the control piston 19, and a lower end of the orifice 43 may be provided with a lower tapered surface 43*b* corresponding to an upper inclined surface of the control valve 13. The orifice 43 may be located between the first drain chamber 41*a* and the second drain chamber 42*a*, and the orifice 43 may be formed in any one of the valve plate 41 or the throttle plate 42. In FIGS. 1 and 2, the orifice 43 may be formed in a lower portion of the valve plate 41.

Figure 3A:
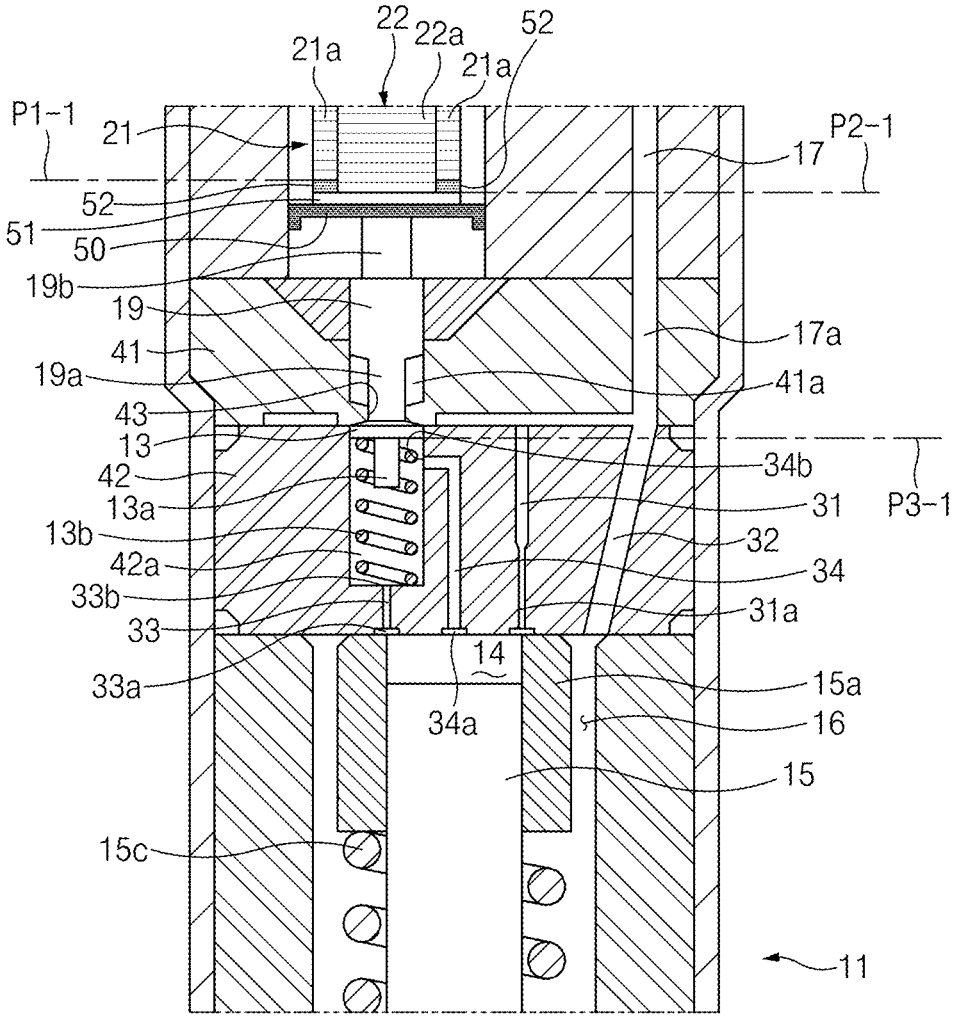
FIG. 3A illustrates a state in which the first and second piezo actuators of FIG. 2 contract.

The controller 80 may selectively apply a current to any one of two or more piezo actuators 21 and 22 or apply a current to two or more piezo actuators 21 and 22 at different timing depending on a rail pressure for a given engine operating condition. Thus, the operations of the individual piezo actuators 21 and 22 may be controlled independently. The control valve 13 may move up and down in accordance with the operations of the individual piezo actuators 21 and 22, and a displacement or stroke of the control valve 13 may be determined. The control valve 13 may move between an open position in which the orifice 43 is opened and a closed position in which the orifice 43 is closed within the determined displacement or stroke. The displacement or stroke of the control valve 13 moving up and down may vary according to the operations of the individual piezo actuators 21 and 22. In particular, down movement distances t1 and t2 of the control valve 13 may vary according to respective expansion operations of the individual piezo actuators 21 and 22, and thus a fuel injection rate pattern may be varied. For example, as illustrated in FIG. 3A, in a state in which the two or more piezo actuators 21 and 22 contract, bottom surfaces P1-1 and P2-1 of the piezo actuators 21 and 22 may be in different positions. As another example, the two or more piezo actuators 21 and 22 may have different expansion rates.

The second drain chamber 42*a* may directly communicate with the control chamber 14 through a first drain throttle 33 and a second drain throttle 34.

When the control valve 13 moves downward and the orifice 43 is opened, the fuel in the control chamber 14 may be drained to the drain chambers 42*a* and 41*a*, which are relatively low pressure spaces, through the first drain throttle 33 and/or the second drain throttle 34. Accordingly, the fuel pressure in the control chamber 14 may become lower than the fuel pressure in the nozzle chamber 16, and a vertical downward force applied to the upper end of the needle 15 may be less than a vertical upward force applied to the lower end of the needle 15. When the vertical downward force is less than the vertical upward force, the needle 15 may move up toward the open position in which the nozzle orifice 12*a* is opened.

When the control valve 13 moves upward and the orifice 43 is closed, the fuel in the control chamber 14 may not be drained to the drain chambers 42*a* and 41*a*. Accordingly, the fuel pressure in the control chamber 14 may become higher than the fuel pressure in the nozzle chamber 16, and the vertical downward force applied to the upper end of the needle 15 may be greater than the vertical upward force applied to the lower end of the needle 15. When the vertical downward force is greater than the vertical upward force, the needle 15 may move down toward the closed position in which the nozzle orifice 12*a* is closed.

In other words, the needle 15 may move up and down to open and close the nozzle orifice 12*a* in response to the movement of the control valve 13.

The throttle plate 42 may have the inlet throttle 31, the nozzle throttle 32, the first drain throttle 33, and the second drain throttle 34.

As mentioned above, the inlet throttle 31 may connect the high-pressure fuel passage 17 to the control chamber 14, and the nozzle throttle 32 may connect the high-pressure fuel passage 17 to the nozzle chamber 16. The second drain chamber 42*a* may communicate with the control chamber 14 through the first drain throttle 33 and the second drain throttle 34.

The first drain throttle 33 may connect a bottom of the second drain chamber 42*a* and the control chamber 14. Specifically, an inlet 33*a* of the first drain throttle 33 may be directly connected to the control chamber 14, and an outlet 33*b* of the first drain throttle 33 may be directly connected to the bottom of the second drain chamber 42*a*. In particular, the first drain throttle 33 may vertically connect the control chamber 14 and the second drain chamber 42*a*. The second drain throttle 34 may connect a lateral side of the second drain chamber 42*a* and the control chamber 14. Specifically, an inlet 34*a* of the second drain throttle 34 may be directly connected to the control chamber 14, and an outlet 34*b* of the second drain throttle 34 may be directly connected to the lateral side of the second drain chamber 42*a*. In other words, the outlet 34*b* of the second drain throttle 34 may be located higher than the outlet 33*b* of the first drain throttle 33.

As the outlet 33*b* of the first drain throttle 33 is directly connected to the bottom of the second drain chamber 42*a*, and the outlet 34*b* of the second drain throttle 34 is directly connected to the lateral side of the second drain chamber 42*a*, the outlet 33*b* of the first drain throttle 33 and the outlet 34*b* of the second drain throttle 34 may be located at different heights in the second drain chamber 42*a* in which the control valve 13 moves. As the control valve 13 moves up and down within the second drain chamber 42*a*, the fuel may be drained (discharged) from the control chamber 14 to the second drain chamber 42*a* through any one of the first drain throttle 33 and the second drain throttle 34.

A length of the second drain throttle 34 may be longer than a length of the first drain throttle 33, and a diameter of the second drain throttle 34 may be larger than a diameter of the first drain throttle 33. Thus, when the control valve 13 moves up and down within the second drain chamber 42*a*, a relatively large amount of fuel may be quickly drained (discharged) from the control chamber 14 to the drain chambers 42*a* and 41*a* through the second drain throttle 34.

The control valve 13 may be connected to the control piston 19 through the lower rod 19*a*, and thus the control valve 13 may move downward by the expansion of each of the piezo actuators 21 and 22, and the control valve 13 may move upward by the contraction of each of the piezo actuators 21 and 22.

The control valve 13 may have a stem 13*a* protruding from a lower end thereof, and a spring 13*b* may be disposed around the stem 13*b* of the control valve 13. Thus, the control valve 13 may be elastically supported by the spring 13*b*, and the control valve 13 may return to its original position by the spring 13*b*.

The valve plate 41 may have a fuel passage 17*a* communicating with the high-pressure fuel passage 17, and the high-pressure fuel passage 17 of the injector body 11 may communicate with the inlet throttle 31 and the nozzle throttle 32 through the fuel passage 17*a* of the valve plate 41.

The throttle plate 42 may have the inlet throttle 31 connecting the fuel passage 17*a* of the valve plate 41 and the control chamber 14. Thus, the high-pressure fuel supplied through the high-pressure fuel passage 17 of the injector body 11 and the fuel passage 17*a* of the valve plate 41 may pass through the inlet throttle 31 and fill the control chamber 14.

The throttle plate 42 may have the nozzle throttle 32 connecting the fuel passage 17*a* of the valve plate 41 and the nozzle chamber 16. Thus, the high-pressure fuel supplied through the high-pressure fuel passage 17 of the injector body 11 and the fuel passage 17*a* of the valve plate 41 may pass through the nozzle throttle 32 and fill the nozzle chamber 16.

The bottom surfaces of the two or more piezo actuators 21 and 22 may be in different positions in a state in which all of the piezo actuators 21 and 22 contract, or the two or more piezo actuators 21 and 22 may have different maximum expansion lengths (or different expansion rates) so that the displacement or stroke of the control valve 13 may be varied. When the two or more piezo actuators 21 and 22 individually expand, the displacement of the control valve 13, i.e., the distances t1 and t2 of the control valve 13 moving downward from the orifice 43 may be different. Thus, the fuel in the control chamber 14 may be drained to the second drain chamber 42*a* through the first drain throttle 33 and/or the second drain throttle 34, and a drain rate of the fuel drained from the control chamber 14 may be varied.

Referring to FIGS. 1-3D, the piezoelectric injector 10 according to an embodiment of the present disclosure may include a first piezo actuator 21 and a second piezo actuator 22 located inward from the first piezo actuator 21. In other words, the first piezo actuator 21 may surround the second piezo actuator 22.

According to an embodiment, when a voltage or current is applied to the first piezo actuator 21, the first piezo actuator 21 may expand, and when no voltage or current is applied to the first piezo actuator 21, the first piezo actuator 21 may contract. When a voltage or current is applied to the second piezo actuator 22, the second piezo actuator 22 may expand, and when no voltage or current is applied to the second piezo actuator 22, the second piezo actuator 22 may contract.

According to an embodiment, as illustrated in FIGS. 1 and 2, the first piezo actuator 21 may be disposed on an edge of the support bracket 50, and the second piezo actuator 22 may be disposed on the center of the support bracket 50. The support bracket 50 may have a first support 51 attached to a top surface thereof, and a second support 52 attached to an edge of the first support 51. In a state in which the first piezo actuator 21 and the second piezo actuator 22 contract, a bottom surface P1 of the first piezo actuator 21 may be supported by a top surface of the second support 52, and a bottom surface of the second piezo actuator 22 may be supported by the top surface of the first support 51. The top surface of the second support 52 may be located higher than the top surface of the first support 51. Referring to FIG. 2, in a state in which all of the piezo actuators 21 and 22 contract, the bottom surface P1 of the first piezo actuator 21 may be located higher than a bottom surface P2 of the second piezo actuator 22. Thus, the down movement distance t1 of the control valve 13 due to the expansion of the first piezo actuator 21 may be less than the down movement distance t2 of the control valve 13 due to the expansion of the second piezo actuator 22.

According to another embodiment, the maximum expansion length of the first piezo actuator 21 may be shorter than the maximum expansion length of the second piezo actuator 22. Thus, the down movement distance t1 of the control valve 13 due to the expansion of the first piezo actuator 21 may be less than the down movement distance t2 of the control valve 13 due to the expansion of the second piezo actuator 22.

Referring to FIG. 3A, when no voltage or current is applied to the first piezo actuator 21, the bottom surface of the first piezo actuator 21 may move to a first contraction position P1-1 due to the contraction of the first piezo actuator 21. When no voltage or current is applied to the second piezo actuator 22, the bottom surface of the second piezo actuator 22 may move to a second contraction position P2-1 due to the contraction of the second piezo actuator 22. When the first piezo actuator 21 contracts and the second piezo actuator 22 contracts, the control valve 13 may move to a closed position P3-1 in which the orifice 43 is closed. Since the orifice 43 is closed, the fuel may not be drained (discharged) from the control chamber 14 to the second drain chamber 42*a*.

Figure 3B:
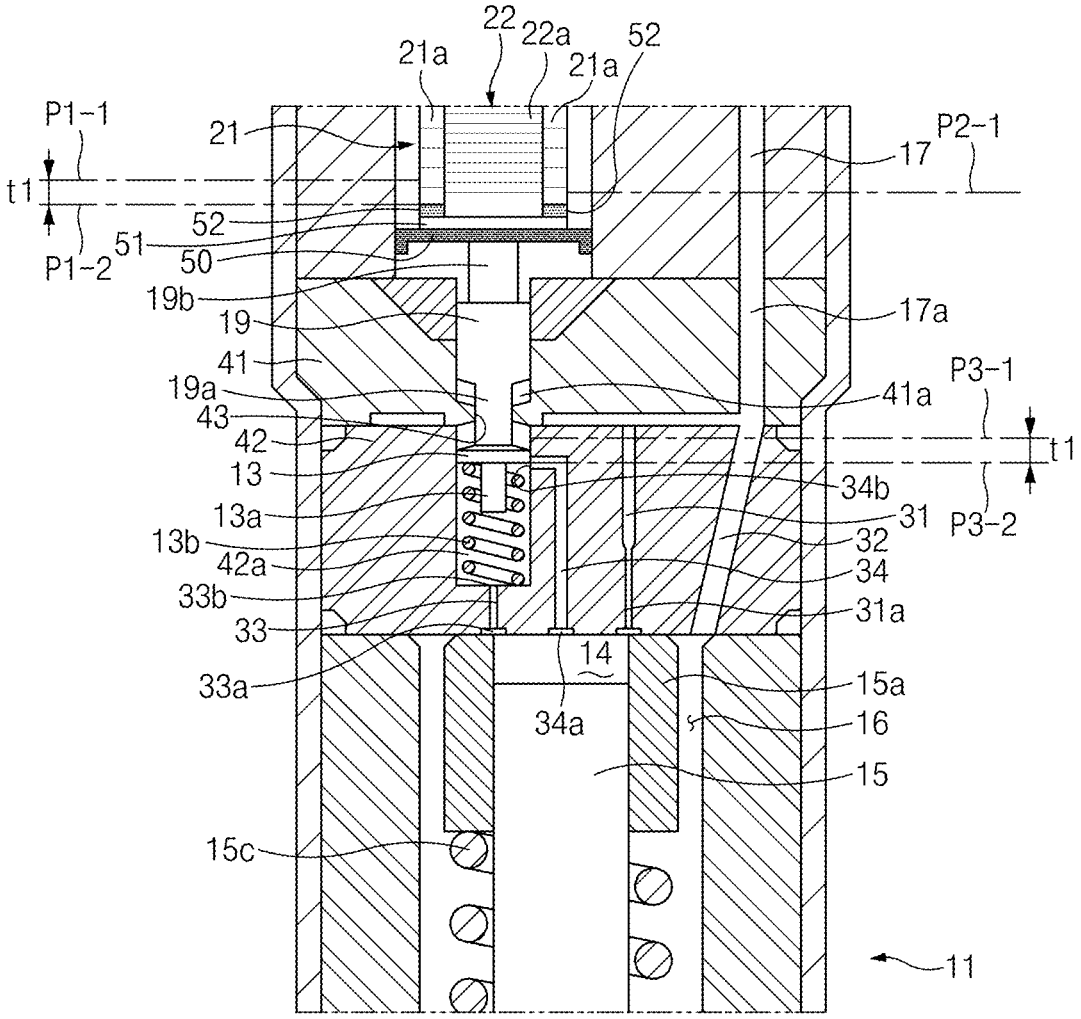
FIG. 3B illustrates a state in which the first piezo actuator of FIG. 2 expands and the second piezo actuator of FIG. 2 contracts.

Referring to FIG. 3B, when a first current C1 is applied to the first piezo actuator 21, the bottom surface of the first piezo actuator 21 may move to a first expansion position P1-2 due to the expansion of the first piezo actuator 21. When no voltage or current is applied to the second piezo actuator 22, the bottom surface of the second piezo actuator 22 may move to the second contraction position P2-1 due to the contraction of the second piezo actuator 22. As the first piezo actuator 21 expands and the second piezo actuator 22 contracts, the control valve 13 may move to a first open position P3-2 in which the orifice 43 is opened. The first open position P3-2 may be spaced apart from the closed position P3-1 by a first distance t1. In this state, the control valve 13 may partially close the outlet 34*b* of the second drain throttle 34 or may be adjacent to and above the outlet 34*b* of the second drain throttle 34. Thus, the fuel in the control chamber 14 may be drained (discharged) to the drain chambers 42*a* and 41*a* through the first drain throttle 33 having a relatively small diameter.

Figure 3C:
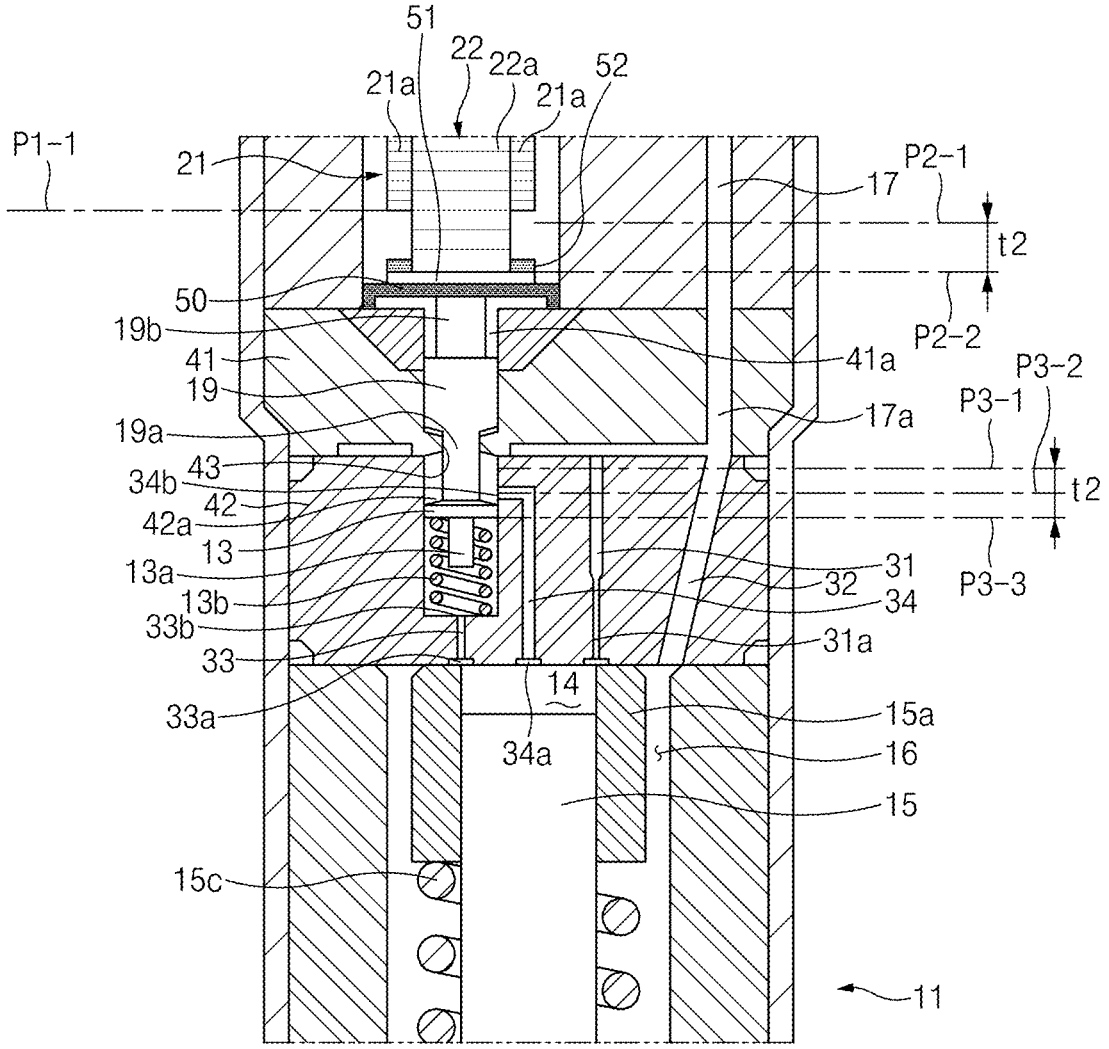
FIG. 3C illustrates a state in which the first piezo actuator of FIG. 2 contracts and the second piezo actuator of FIG. 2 expands.

Referring to FIG. 3C, when no voltage or current is applied to the first piezo actuator 21, the bottom surface of the first piezo actuator 21 may move to the first contraction position P1-1 due to the contraction of the first piezo actuator 21. When a second current C2 is applied to the second piezo actuator 22, the bottom surface of the second piezo actuator 22 may move to a second expansion position P2-2 due to the expansion of only the second piezo actuator 22. Accordingly, the control valve 13 may move to a second open position P3-3 in which the orifice 43 is opened. The second open position P3-3 may be spaced apart from the closed position P3-1 by a second distance t2, and the second open position P3-3 may be located below the first open position P3-2. In other words, the second distance t2 may be greater than the first distance t1. In particular, when the control valve 13 moves to the second open position P3-3, the control valve 13 may be located below the outlet 34*b* of the second drain throttle 34, and the outlet 34*b* of the second drain throttle 34 may be fully opened. Thus, the fuel in the control chamber 14 may be drained (discharged) to the drain chambers 42*a* and 41*a* through the second drain throttle 34. In other words, the fuel in the control chamber 14 may be drained (discharged) to the drain chambers 42*a* and 41*a*, which are relatively low pressure spaces, through the second drain throttle 34 having a relatively large diameter. Since the diameter of the second drain throttle 34 is larger than the diameter of the first drain throttle 33, a relatively large amount of fuel may be quickly drained from the control chamber 14 to the second drain chamber 42*a*.

Figure 3D:
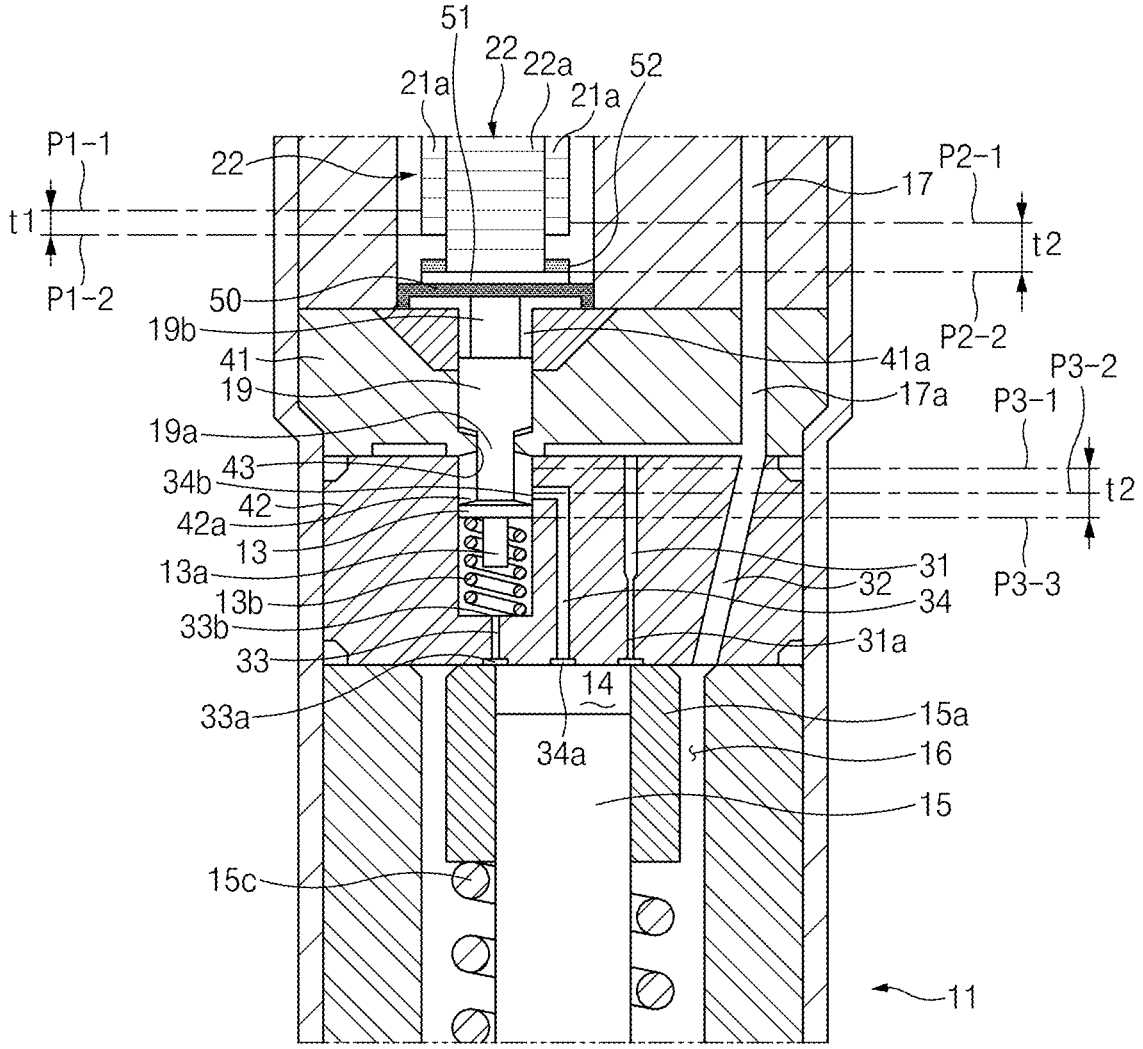
FIG. 3D illustrates a state in which the second piezo actuator of FIG. 2 expands after the first piezo actuator of FIG. 2 expands.

Referring to FIG. 3D, when the first current C1 is applied to the first piezo actuator 21 and then the second current C2 is applied to the second piezo actuator 22, the bottom surface of the first piezo actuator 21 may move to the first expansion position P1-2 due to the expansion of the first piezo actuator 21, and then the bottom surface of the second piezo actuator 22 may move to the second expansion position P2-2 due to the expansion of the second piezo actuator 22. Accordingly, the control valve 13 may move to the first open position P3-2, and then to the second open position P3-3 sequentially. As the control valve 13 moves to the first open position P3-2 and then to the second open position P3-3, the fuel in the control chamber 14 may be drained to the drain chambers 42*a* and 41*a* through the first drain throttle 33 and then be drained to the drain chambers 42*a* and 41*a* through the second drain throttle 34. In other words, as the first current C1 and the second current C2 are applied to the first piezo actuator 21 and the second piezo actuator 22 at different timing, the expansion of the first piezo actuator 21 and the expansion of the second piezo actuator 22 may occur sequentially. Thus, the fuel in the control chamber 14 may be drained through the first drain throttle 33 and the second drain throttle 34 sequentially, and accordingly an injection rate pattern of the fuel injected through the nozzle orifice 12*a* may be varied.

Figure 4:
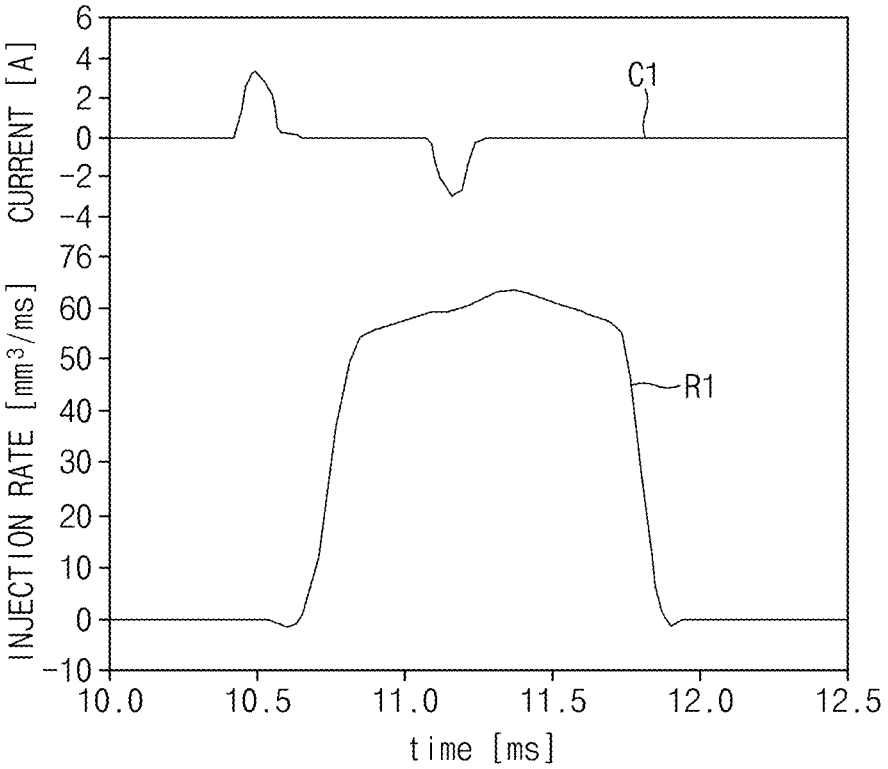
FIG. 4 illustrates a current applied to a first piezo actuator and an injection rate pattern of fuel injected through a nozzle orifice when the fuel in a control chamber is only drained (discharged) through a first drain throttle due to expansion of only the first piezo actuator.

FIG. 4 illustrates a pattern of a first injection rate R1 of fuel injected through the nozzle orifice 12*a* of the injector body 11 when the first current C1 is applied to the first piezo actuator 21 and the fuel in the control chamber 14 is only drained (discharged) through the first drain throttle 33 due to the expansion of the first piezo actuator 21 (see FIG. 3B). In other words, when the first piezo actuator 21 expands, the pattern of the first injection rate R1 may be similar to or the same as that of an existing piezo injector.

Figure 5:
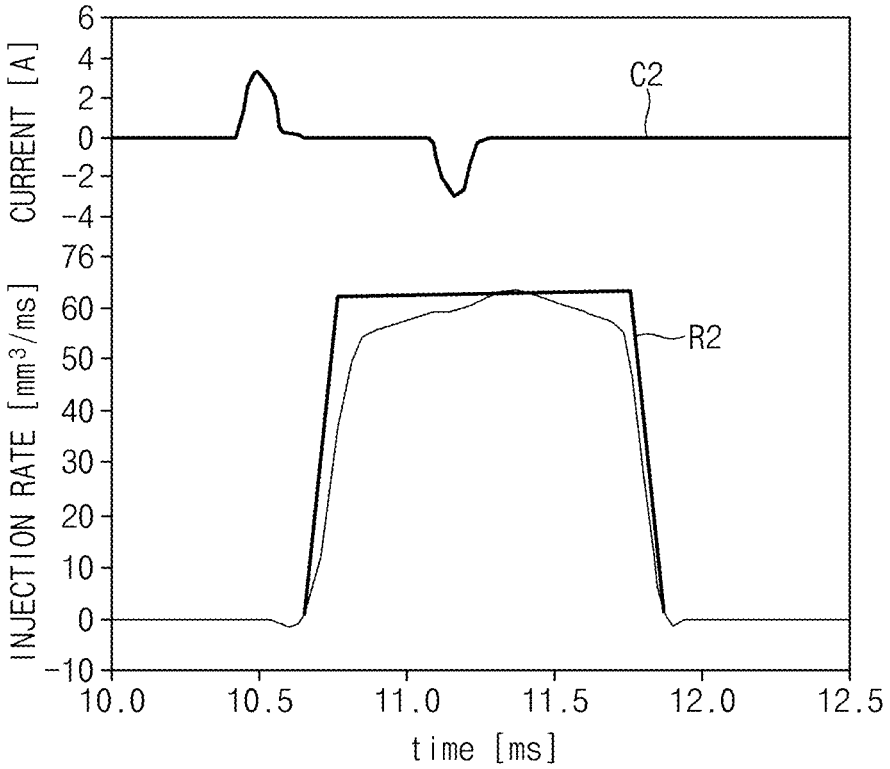
FIG. 5 illustrates a current applied to a second piezo actuator and an injection rate pattern of fuel injected through a nozzle orifice when the fuel in a control chamber is only drained (discharged) through a second drain throttle due to expansion of only the second piezo actuator.

FIG. 5 illustrates a pattern of a second injection rate R2 of fuel injected through the nozzle orifice 12*a* of the injector body 11 when the second current C2 is applied to the second piezo actuator 22 and the fuel in the control chamber 14 is only drained (discharged) through the second drain throttle 34 due to the expansion of the second piezo actuator 22 (see FIG. 3C). Since the diameter of the second drain throttle 34 is larger than the diameter of the first drain throttle 33, a relatively large amount of fuel may be quickly drained from the control chamber 14 to the drain chambers 42*a* and 41*a*. In other words, a drain rate (drain speed) of fuel passing through the second drain throttle 34 may be faster than that of fuel passing through the first drain throttle 33, and thus a fuel pressure change rate in the control chamber 14 may increase, which may speed up the opening of the nozzle orifice 12*a* of the injector body 11. In other words, since an opening rate (gradient) of the nozzle orifice 12*a* is relatively high, the pattern of the second injection rate R2 may have a steeper gradient than the pattern of the first injection rate R1 illustrated in FIG. 4.

Figure 6:
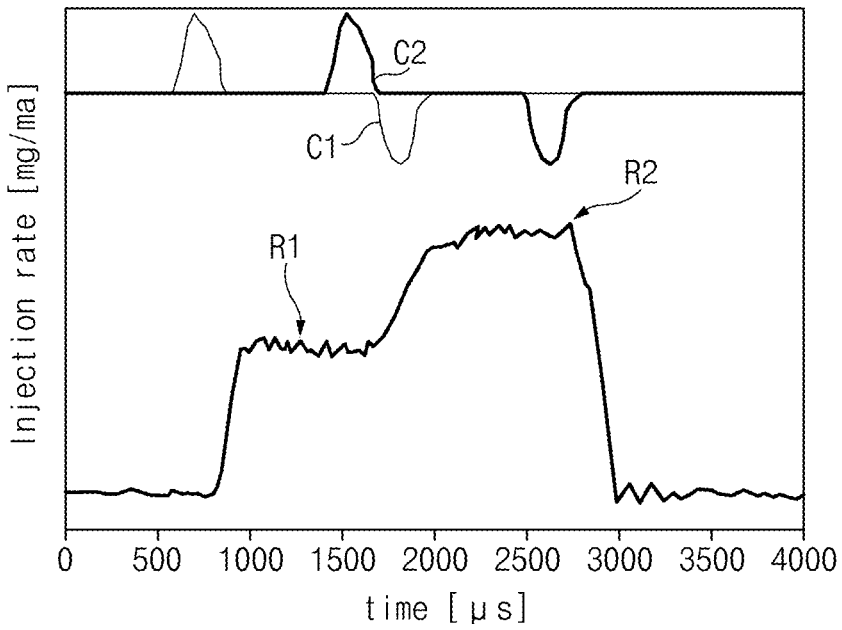
FIG. 6 illustrates currents applied to first and second piezo actuators and an injection rate pattern of fuel injected through a nozzle orifice when the fuel in a control chamber is drained (discharged) sequentially through a first drain throttle and a second drain throttle due to sequential occurrence of expansion of the first piezo actuator and expansion of the second piezo actuator.

FIG. 6 illustrates the occurrence of the expansion of the first piezo actuator 21 and the expansion of the second piezo actuator 22 at different timing when the currents C1 and C2 are applied to the first piezo actuator 21 and the second piezo actuator 22 at different timing. As illustrated in FIG. 3D, when the first current C1 is applied to the first piezo actuator 21 and then the second current C2 is applied to the second piezo actuator 22, the first piezo actuator 21 may expand, and then the second piezo actuator 22 may expand. When the fuel in the control chamber 14 is discharged through the first drain throttle 33 due to the expansion of the first piezo actuator 21, the fuel pressure change rate of the control chamber 14 may be relatively low, and thus the opening of the nozzle orifice 12*a* of the injector body 11 may be relatively slow. In this case, the fuel may be injected through the nozzle orifice 12*a* of the injector body 11 at the first injection rate R1. Thereafter, when the fuel in the control chamber 14 is discharged through the second drain throttle 34 due to the expansion of the second piezo actuator 22, the fuel pressure change rate of the control chamber 14 may be relatively high, and thus the nozzle orifice 12*a* of the injector body 11 may be opened relatively quickly. In this case, the fuel may be injected through the nozzle orifice 12*a* of the injector body 11 at the second injection rate R2, and the second injection rate R2 may be higher than the first injection rate R1. In other words, as the fuel in the control chamber 14 are sequentially drained through the first drain throttle 33 and the second drain throttle 34 having different diameters, the injection rates R1 and R2 of the fuel injected through the nozzle orifice 12*a* may be varied in a stepwise manner.

Figure 7:
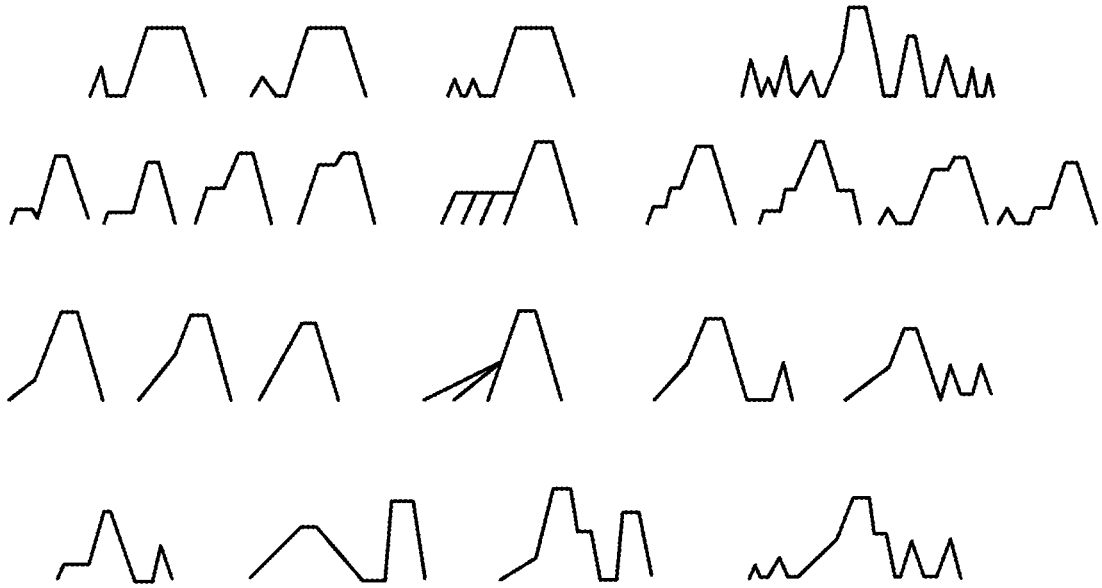
FIG. 7 illustrates examples of various fuel injection rate patterns created by a piezoelectric injector according to embodiments of the present disclosure.

The piezoelectric injector 10 according to embodiments of the present disclosure may create variations in fuel injection rate patterns depending on the arrangement of two or more piezo actuators 21 and 22, the operating conditions of two or more piezo actuators 21 and 22, etc. FIG. 7 illustrates examples of various fuel injection rate patterns according to embodiments of the present disclosure.

In the above-described configuration, the controller 80 may selectively apply a current to any one of two or more piezo actuators 21 and 22 or apply a current to two or more piezo actuators 21 and 22 at different timing depending on a rail pressure for a given engine operating condition. Thus, the operations of the individual piezo actuators 21 and 22 may be controlled independently. The displacement or stroke of the control valve 13 may be varied according to the operations (expansion and/or contraction) of the individual piezo actuators 21 and 22. As the displacement or stroke of the control valve 13 is varied, the fuel may be drained (discharged) from the control chamber 14 to the drain chambers 42*a* and 41*a* through the first drain throttle 33 and/or the second drain throttle 34. As the fuel is selectively drained through the first drain throttle 33 and the second drain throttle 34 having different diameters, or as the fuel is drained through the first drain throttle 33 and the second drain throttle 34 at different timing, the fuel drain rate (drain speed) may be varied. As the fuel drain rate is varied, the fuel pressure change rate in the control chamber 14 may be varied, and accordingly the fuel injection rate of the fuel injected through the nozzle 12 of the injector body 11 may be varied. In other words, the drain rate of the fuel drained from the control chamber 14 may be varied depending on selective operations of the two or more piezo actuators 21 and 22, and accordingly the fuel pressure change rate in the control chamber 14 and the fuel injection rate may be varied.

Figure 8:
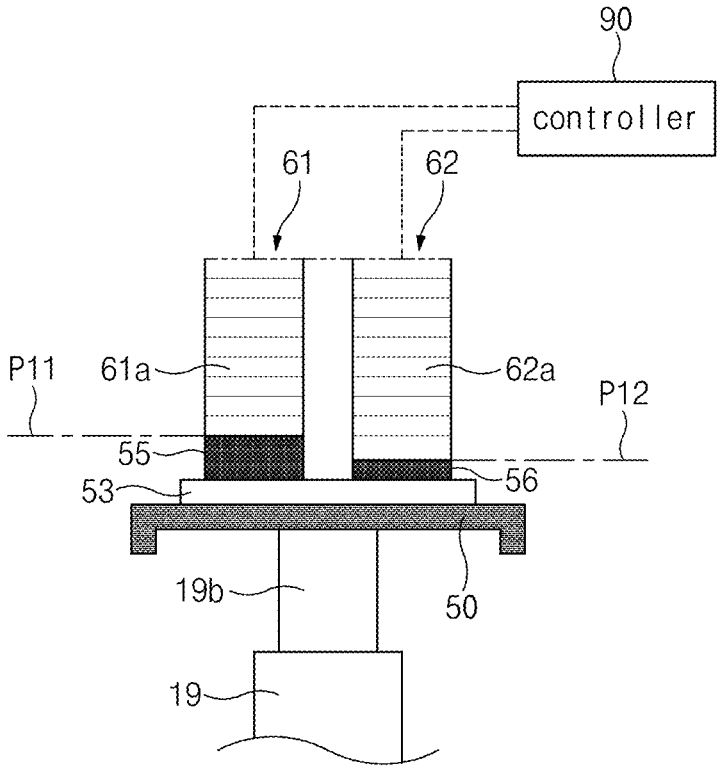
FIG. 8 illustrates the arrangement of two or more piezo actuators in a piezoelectric injector according to another embodiment of the present disclosure.

FIG. 8 illustrates the arrangement of two or more piezo actuators according to another embodiment of the present disclosure. Referring to FIG. 8, a first piezo actuator 61 and a second piezo actuator 62 may be parallel to each other above the support bracket 50. In other words, the two or more piezo actuators 61 and 62 may be arranged in parallel to each other above the support bracket 50. A base support 53 may be attached to the top surface of the support bracket 50, and a first support 55 and a second support 56 may be attached side by side to a top surface of the base support 53. A bottom surface of the first support 55 may be flush with a bottom surface of the second support 56, and a top surface of the first support 55 may be located higher than a top surface of the second support 56. A bottom surface P11 of the first piezo actuator 61 may be supported by the top surface of the first support 55, and a bottom surface P12 of the second piezo actuator 62 may be supported by the top surface of the second support 56. In a state in which all of the piezo actuators 61 and 62 contract, the bottom surface P11 of the first piezo actuator 61 may be located higher than the bottom surface P12 of the second piezo actuator 62. Due to the expansion of each of the piezo actuators 61 and 62, the displacement of the control valve 13 may be varied. As the displacement of the control valve 13 is varied, the fuel may be drained from the control chamber 14 to the drain chambers 42*a* and 41*a* through the first drain throttle 33 and/or the second drain throttle 34.

Figure 9:
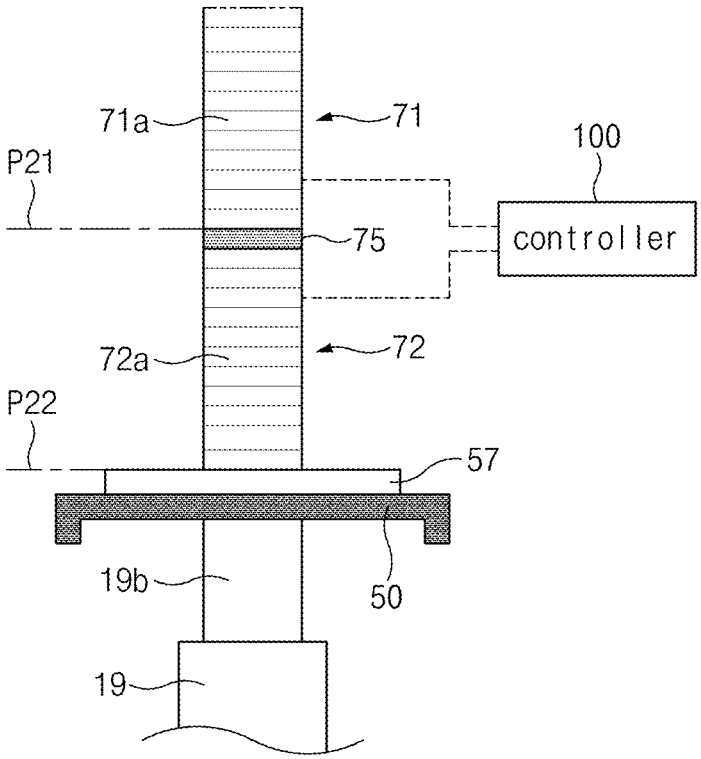
FIG. 9 illustrates the arrangement of two or more piezo actuators in a piezoelectric injector according to another embodiment of the present disclosure.

FIG. 9 illustrates the arrangement of two or more piezo actuators according to another embodiment of the present disclosure. Referring to FIG. 9, a first piezo actuator 71 and a second piezo actuator 72 may be vertically stacked on the support bracket 50. In other words, the two or more piezo actuators 71 and 72 may be vertically arranged in series above the support bracket 50. A base support 57 may be attached to the top surface of the support bracket 50, and the first piezo actuator 71 may be located above the second piezo actuator 72. A bottom surface of the second piezo actuator 72 may be supported by a top surface of the base support 57. A spacer of an insulating material may be interposed between the first piezo actuator 71 and the second piezo actuator 72. A bottom surface P21 of the first piezo actuator 71 may be located higher than a bottom surface P22 of the second piezo actuator 72. Due to the expansion of each of the piezo actuators 71 and 72, the displacement of the control valve 13 may be varied. As the displacement of the control valve 13 is varied, the fuel may be drained from the control chamber 14 to the drain chambers 42*a* and 41*a* through the first drain throttle 33 and/or the second drain throttle 34.

As set forth above, according to embodiments of the present disclosure, by varying or changing the fuel injection rate pattern depending on the rail pressure corresponding to any particular engine operating condition, variable control of the fuel injection rate may be efficiently performed. Optimal mapping with respect to the demands of each operating point of the engine through variable control of the fuel injection rate may effectively improve fuel efficiency, smoke emissions reduction, and low combustion noise under the same EM condition.

According to embodiments of the present disclosure, as the bottom surfaces of two or more piezo actuators are located at different heights in a state in which the piezo actuators contract, the displacement of the control valve may be varied. Thus, the drain rate of the fuel drained from the control chamber may be varied so that the pattern of the fuel injection rate may be varied.

Hereinabove, although the present disclosure has been described with reference to embodiments and the accompanying drawings, the present disclosure is not limited thereto, but may be variously modified and altered by those having ordinary skill in the art to which the present disclosure pertains without departing from the spirit and scope of the present disclosure claimed in the following claims.

What is claimed is:

1. A piezoelectric injector, comprising:

an injector body having a high-pressure fuel passage;

a nozzle provided in a lower end portion of the injector body, and having at least one nozzle orifice;

a first piezo actuator and a second piezo actuator disposed inside the injector body;

a control valve connected to the first piezo actuator and the second piezo actuator through a control piston;

at least one drain chamber in which the control valve and the control piston are movably received;

a control chamber connected to the drain chamber through a first drain throttle and a second drain throttle; and a needle movable by a change in fuel pressure of the control chamber to open and close the nozzle orifice, wherein a fuel is drained from the control chamber to the drain chamber through at least one of the first drain throttle and the second drain throttle as at least one of the first piezo actuator and the second piezo actuator expands.

2. The piezoelectric injector according to claim 1, wherein the first piezo actuator and the second piezo actuator vary a displacement of the control valve.

3. The piezoelectric injector according to claim 1, wherein the first drain throttle and the second drain throttle have different diameters.

4. The piezoelectric injector according to claim 3, wherein the first drain throttle connects a bottom of the drain chamber and an upper end of the control chamber.

5. The piezoelectric injector according to claim 4, wherein the second drain throttle connects a lateral side of the drain chamber and the upper end of the control chamber.

6. The piezoelectric injector according to claim 5, wherein a diameter of the second drain throttle is larger than a diameter of the first drain throttle.

7. The piezoelectric injector according to claim 1, wherein the first piezo actuator is located outward from the second piezo actuator.

8. The piezoelectric injector according to claim 7, wherein the first piezo actuator and the second piezo actuator are connected to the control piston through a support bracket, the first piezo actuator is disposed on an edge of the support bracket, and the second piezo actuator is disposed on a center of the support bracket.

9. The piezoelectric injector according to claim 8, wherein the support bracket has a first support supporting the second piezo actuator, and a second support supporting the first piezo actuator.

10. The piezoelectric injector according to claim 9, wherein a top surface of the second support is located higher than a top surface of the first support.

11. The piezoelectric injector according to claim 7, wherein the first piezo actuator and the second piezo actuator are arranged in parallel to each other.

12. The piezoelectric injector according to claim 7, wherein the first piezo actuator and the second piezo actuator are vertically stacked.

13. A method for controlling a piezoelectric injector, the piezoelectric injector comprising: a first piezo actuator and a second piezo actuator; a control valve which is connected to the first piezo actuator and the second piezo actuator through a control piston; at least one drain chamber in which the control valve and the control piston are movably received; a control chamber which is connected to the drain chamber through a first drain throttle and a second drain throttle having different diameters; a needle which is movable by a change in fuel pressure of the control chamber to open and close at least one nozzle orifice; and a controller controlling the first piezo actuator and the second piezo actuator, wherein a fuel is drained from the control chamber to the drain chamber through at least one of the first drain throttle and the second drain throttle as at least one of the first piezo actuator and the second piezo actuator expands, the method comprising:

applying, by the controller, a current to at least one of the first piezo actuator and the second piezo actuator so that at least one of the first piezo actuator and the second piezo actuator expands.

14. The method according to claim 13, wherein the controller applies the current to the first piezo actuator and the second piezo actuator at different timing so that the first piezo actuator and the second piezo actuator expand at different timing.

15. The method according to claim 13, wherein the controller only applies the current to the first piezo actuator so that only the first piezo actuator expands.

16. The method according to claim 13, wherein the controller only applies the current to the second piezo actuator so that only the second piezo actuator expands.

17. The method according to claim 13, wherein the controller applies the current to the first piezo actuator and the second piezo actuator sequentially so that the first piezo actuator expands and the second piezo actuator expands sequentially.

* * * * *